US008276600B2

(12) United States Patent
Perpezat et al.

(10) Patent No.: US 8,276,600 B2
(45) Date of Patent: Oct. 2, 2012

(54) SCRAPER MACHINE

(75) Inventors: Daniel Perpezat, Rueil Malmaison (FR); Jean-Marc Sabatie, Nanterre (FR)

(73) Assignee: Compagnie du Sol, Rueil Malmaison (FR)

( * ) Notice: Subject to any disclaimer, the term of this patent is extended or adjusted under 35 U.S.C. 154(b) by 610 days.

(21) Appl. No.: 12/402,995

(22) Filed: Mar. 12, 2009

(65) Prior Publication Data

US 2009/0229631 A1 Sep. 17, 2009

(30) Foreign Application Priority Data

Mar. 12, 2008 (FR) ..... 08 51605

(51) Int. Cl.
*B08B 3/04* (2006.01)

(52) U.S. Cl. .... 134/104.2; 15/93.1; 15/93.3; 134/166 R; 134/166 C

(58) Field of Classification Search ..... None
See application file for complete search history.

(56) References Cited

U.S. PATENT DOCUMENTS

| | | | |
|---|---|---|---|
| 3,138,327 | A | 6/1964 | Jacobs |
| 4,007,693 | A | 2/1977 | Desourdy |

FOREIGN PATENT DOCUMENTS

| | | | |
|---|---|---|---|
| DE | 1 188 026 | B | 3/1965 |
| FR | 2693220 | A1 * | 1/1994 |
| FR | 2701278 | A1 * | 8/1994 |
| JP | 08232293 | A * | 9/1996 |

* cited by examiner

*Primary Examiner* — Michael Kornakov
*Assistant Examiner* — Eric Golightly
(74) *Attorney, Agent, or Firm* — Kenyon & Kenyon LLP

(57) ABSTRACT

The invention relates to a machine for scraping away sediment or the like deposited on the bottom of a gallery. The machine comprises: a first movable body suitable for moving over the bottom portion of the wall of the gallery; first movement means for moving said first movable body; scraper means for detaching sediment from the bottom; first buffer storage means mounted on said first movable body; first transfer means for transferring detached sediment into said first storage means; second transfer means for transferring sediment stored in said first buffer storage means to the outside of said first movable body; a second movable body; second movement means; and second storage means mounted on said second movable body to collect the transferred sediment.

7 Claims, 3 Drawing Sheets

SCRAPER MACHINE

FIELD OF THE INVENTION

The present invention provides a machine for scraping away sediment or the like that is deposited on the bottom of a gallery, e.g. a drain, and to a method of scraping away said sediment.

BACKGROUND OF THE INVENTION

Scraping, i.e. removing sediment or other undesirable material that has become deposited on the bottom of a drain or more generally of a gallery, raises a certain number of problems. The machine of the invention relates more particularly to a system that makes it possible to scrap sewers in a drainage network for conveying waste water or the like. As time progresses, material settles on the bottoms of the galleries constituting such drains. The operator periodically subcontracts the work of scraping said galleries.

At present, such galleries are usually scraped by the following technique:

- a dam is set up so as to enable the gallery for scraping to be unwatered; and
- scraping is performed by a self-propelled loader, e.g. of the type used in mines, having a bucket fitted with a blade for scraping the bottom of the gallery. Once the bucket is full, the loader needs to perform a go-and-return trip between the scraping front and an access point to the surface where the bucket can be emptied. The bucket of the loader is emptied by filling a skip, that is then raised by means of a crane in order to be taken away. Such a solution is described in French patent No. 2 701 278.

The main drawback of such a drain scraper machine is that while the scraper vehicle is traveling, scraping is interrupted. It will be understood that as the distance between the scraping front and the point for removing recovered sediment increases, so the productivity of the machine decreases.

In addition, the type of vehicle described in the prior art usually consists in a mechanical digger type machine with conventional crawler tracks and it requires the gallery that is to be treated to be unwatered. It will be understood that the necessity for the machine to perform go-and-return trips between the scraping front and the unloading zone leads to long periods during which the scraping machine is not scraping. This leads to a very significant reduction in the efficiency of the machine.

OBJECT AND SUMMARY OF THE INVENTION

A first object of the invention is to provide a machine for scraping away sediment or the like, and that enables the above-mentioned drawbacks to be avoided.

To achieve this object, the invention provides a machine for scraping away sediment or the like deposited on the bottom of a gallery, wherein the machine comprises:

- a first movable body suitable for moving over the bottom portion of the wall of the gallery, said first movable body presenting a front and a rear;
- first movement means for enabling said first movable body to move on the bottom portion of the wall of the gallery;
- scraper means for detaching sediment from the bottom of the gallery and mounted at the front of said first movable body;
- first storage means mounted on said first movable body;
- first transfer means for transferring detached sediment into said first storage means;

- second transfer means for transferring sediment stored in said first storage means to the outside of said first movable body;
- a second movable body, distinct from the first movable body, and suitable for moving along the bottom portion of the wall of the gallery;
- second movement means for enabling said second movable body to move on the bottom portion of the wall of the gallery; and
- second storage means mounted on said second movable body to collect the sediment transferred to the outside of the first movable body by second transfer means.

It will be understood that because the complete machine is made up of a first movable body, referred to below as the "scraper vehicle", that performs the scraping operation proper, and that is fitted with buffer storage means for temporarily storing sediment removed from the bottom of the gallery, it is possible for the machine to include a second movable body, referred to as a "removal vehicle", that can independently and periodically receive the sediment or the like as stored temporarily on the scraper vehicle and transport it to the zone of the gallery or the drain that corresponds to sediment removal. It will naturally be understood that while the removal vehicle is performing go-and-return trips, the scraper vehicle can work continuously because of the presence of the temporary or buffer storage means referred to as "first" storage means.

Preferably, the first movement means are first motor means mounted on the first movable body, or scraper vehicle.

Also preferably, the second movement means are second motor means mounted on the second movable body, or removal vehicle.

Also preferably, the first transfer means comprise a loader auger placed in register with the scraper means and/or a conveyor having a first end co-operating with the loader auger or the scraper device, and a second end that is located above the first storage means.

Also preferably, said first storage means are located at the rear of the first movable body.

Also preferably, the second transfer means are mounted on said first movable body.

The invention also provides a method of scraping sediment, particularly but not exclusively suitable for being implemented with the help of the above-defined machine.

According to the invention, the method of scraping sediment or the like deposited on the bottom of a gallery comprises the following steps:

- moving a first movable body provided with scraper means on the bottom portion of the gallery;
- storing sediment on said movable body as it is removed;
- moving a second movable body on the bottom portion of the wall of the gallery;
- periodically transferring the sediment stored on the first movable body to the second movable body while the second movable body is kept close to the first movable body;
- after the sediment has been transferred, moving the second movable body between its position close to the first movable body to a second stationary position for unloading the sediment stored on said second movable body to the outside of the gallery; and
- returning said second movable body towards its position close to the first movable body;

whereby the first movable body can perform the scraping operation continuously, including during stages of unloading the sediment with the help of the second movable body.

BRIEF DESCRIPTION OF THE DRAWINGS

Other characteristics and advantages of the invention appear better on reading the following description of an embodiment of the invention given as a non-limiting example.

The description refers to the accompanying figures, in which.

MORE DETAILED DESCRIPTION

Figure 1:
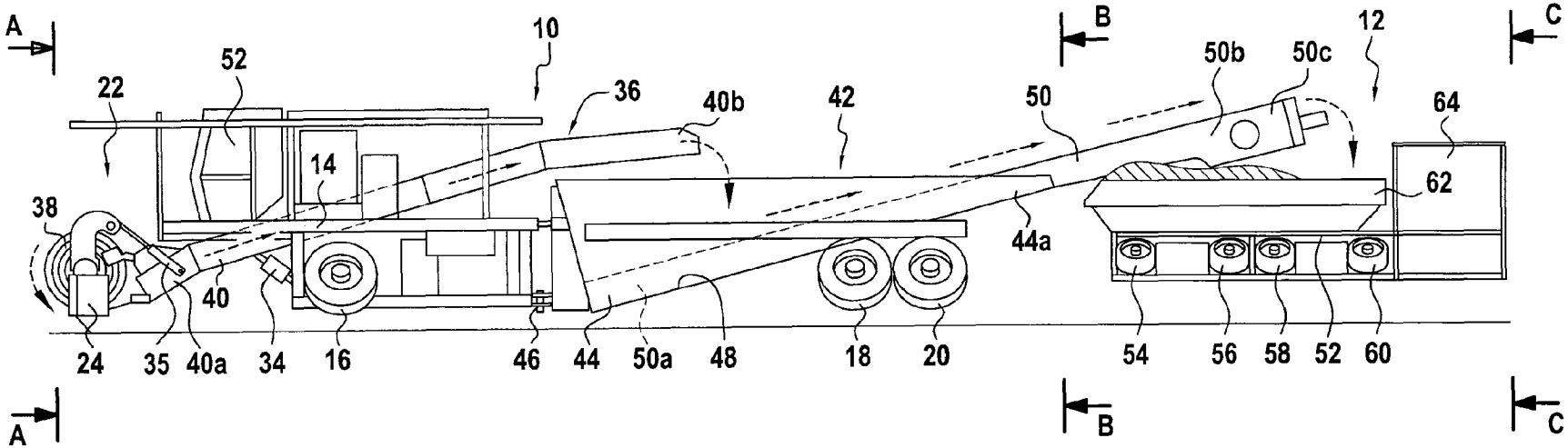
FIG. 1 is a side view of the vehicle as a whole.

With reference initially to FIG. 1, there follows a description of the general structure of the scraper machine. As mentioned above, the scraper machine is essentially constituted by a scraper vehicle 10 and by a removal vehicle 12. The scraper vehicle constitutes the first movable body and the removal vehicle constitutes the second movable body. The scraper vehicle 10 comprises a support chassis 14 fitted with a front wheel set 16, and in the particular example described, with two rear wheel sets 18 and 20. At the front 22 of the scraper vehicle, there can be seen a vehicle device 24 that is essentially constituted by a cleaner or scraper blade 26 that can be seen more clearly in FIG. 2A. As shown in this figure, the shape of the shaft portion of the scraper blade 26 matches the shape of the bottom portion 28 of the wall 30 of the gallery or drain 32 in which the scraper machine is to operate. Preferably, the scraper device 24 can take up a raised position on standby and a lowered position in operation. An actuator 34 serves to move between these positions.

The scraper device 24 is associated with first transfer means for transferring sediment and other debris recovered by the blade 26 and given overall reference 36. Preferably, the first transfer means 36 are constituted by a loader auger 38 placed in relationship with the scraper blade 26. The loader auger 38 is preferably constituted by two end portions 38*a* and 38*b*, each provided with a respective screw 37, and a central portion 38*c* having no screw. The function of the loader auger 38 is firstly to use its screws 37 to cut up pieces of sediment scraped from the bottom of the gallery, and secondly to convey these cut-up pieces of sediment towards the center. An actuator 35 preferably serves to move the auger 38 from a raised position to a lowered, working position.

The first transfer means 36 also comprise a conveyor 40 having a first end 40*a* facing the loader auger 38 and preferably secured to the scraper blade 26, and a second end 40*b*. Naturally, both the loader auger 38 and the conveyor 40 are mounted on the chassis of the scraper vehicle. At its rear end 42, the scraper vehicle also has a buffer tank 44 that constitutes the first storage means. This portion, which is secured to the rear wheel sets 18 and 20, is preferably hinged about a vertical axis 46 relative to the front portion of the scraper vehicle 10. The hinge 46 enables the scraper vehicle 10 to match the path followed by the gallery 30. The buffer tank 44 preferably has a sloping bottom 38. The scraper vehicle 10 also has second transfer means constituted by a conveyor 50. The conveyor 50 has a first portion 50*a* that is disposed inside the tank 44 close to its bottom 48, and a second portion 50*b* that is outside the tank. The end 50*c* of the conveyor 50 is placed well beyond the rear end 44*a* of the tank 44.

Figure 2A:
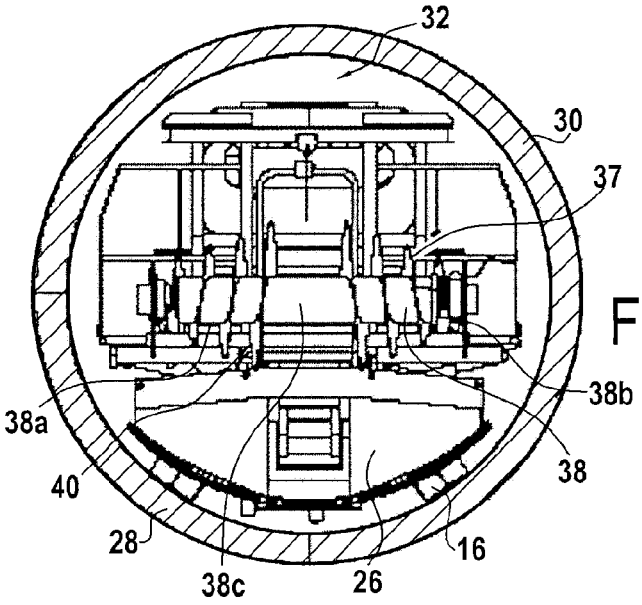
FIG. 2A is a view of the vehicle looking along arrows A-A, the scraper blade and the loader auger being in the raised position.
Figure 2B:
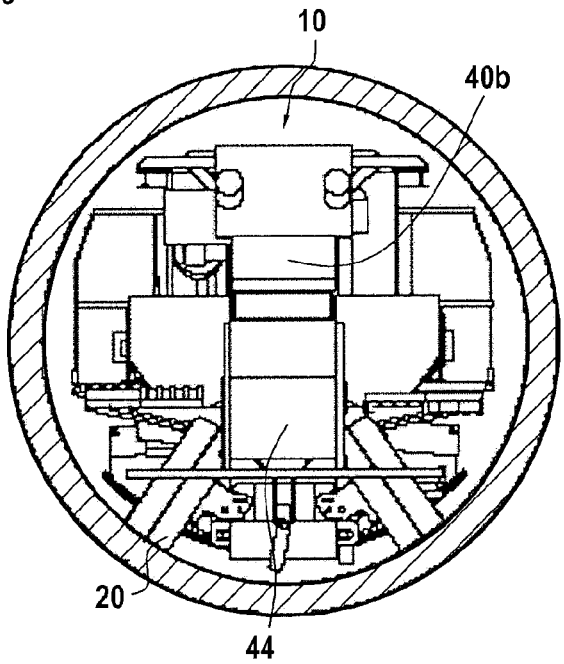
FIG. 2B is a view of the scraper vehicle as seen looking along arrows B-B.
Figure 2C:
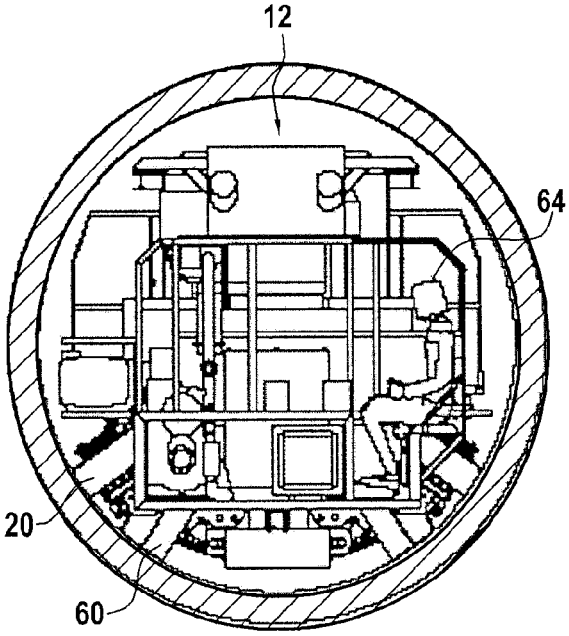
FIG. 2C is a view of the removal vehicle as seen looking along arrows C-C of FIG. 1.

As can be seen better in FIG. 2A, the wheel sets 16, 18, and 20 are mounted to pivot about axes that are at an angle relative to the horizontal. This disposition makes it possible to match the movement of the scraper vehicle to the shape of the bottom 28 of the wall 30 of the gallery.

Naturally, the scraper vehicle 10 also includes a cabin 52 for driving the vehicle, motors (not shown) for driving the wheel sets, these motors being hydraulic motors, for example. The chassis 40 also carries pressurized fluid feeder means for driving the loader auger 38 in rotation, for driving the actuators 34 and 35 that change the position of the scraper blade 26 and of the auger 38, and also for driving the conveyors 40 and 50.

The scraper machine also has a second movable body that is constituted by the removal vehicle 12 that serves, as explained above, to transfer sediments between the scraper vehicle 10 and an unloading zone provided in the gallery. The removal vehicle 12 is essentially constituted by chassis 52, e.g. fitted with four wheel sets 54, 56, 58, and 60.

These wheels are naturally likewise on axes of rotation that are inclined relative to the horizontal so as to bear against the walls of the gallery. Preferably, these wheels bear against the wall at a position that is further from the bottom of the gallery than the positions where the wheel sets 16 to 20 of the scraper vehicle 10 bear. This produces better running conditions for the removal vehicle, since the bottom of the gallery may be uneven. It will be understood that this disposition is particularly advantageous, since although the scraper vehicle 10 moves only very slowly and runs along the distance corresponding to the length of the gallery for scraping only once, the removal vehicle 12 is used to perform a large number of go-and-return journeys between the scraper vehicle 10 and the unloading point. The removal vehicle 12 is fitted with a storage skip 62 that is preferably removable from the chassis 52 of the removal vehicle 12. The removal vehicle 12 is also fitted with a driver's cabin 64 and with motors for driving at least some of the wheel sets 54 to 60.

The wheels may either be standard wheels, or else they may be roller wheels of the type described in French patent FR 2 808 491 in the name of the Applicant.

The travel speed of the scraper vehicle 10 when in operation is naturally very limited in order to obtain effective scraping of the gallery. By way of example it may lie in the range 1 meter per minute (m/min) to 2 m/min. In contrast, on making its go-and-return trips, the removal vehicle 12 may naturally travel at a higher speed, e.g. of the order of 15 kilometers per hour (km/h).

To optimize the operation of the scraper machine, it is desirable to define appropriately the volume capacity of the tank 44 of the scraper vehicle 10. This volume capacity must be not less than the quantity of sediment extracted by the scraper vehicle 10 while the removal vehicle 12 makes a go-and-return trip between the scraper vehicle 10 and the point for unloading sediment, while the scraper vehicle 10 is itself at its greatest distance from the unloading point. First storage means (the tank 44) thus constitutes a buffer zone for temporary retention of the results of scraping that thus serve to make the two movable vehicles independent of each other. Naturally, it is also necessary for the capacity of the skip 62 to match that of the tank 44.

Figure 3A:
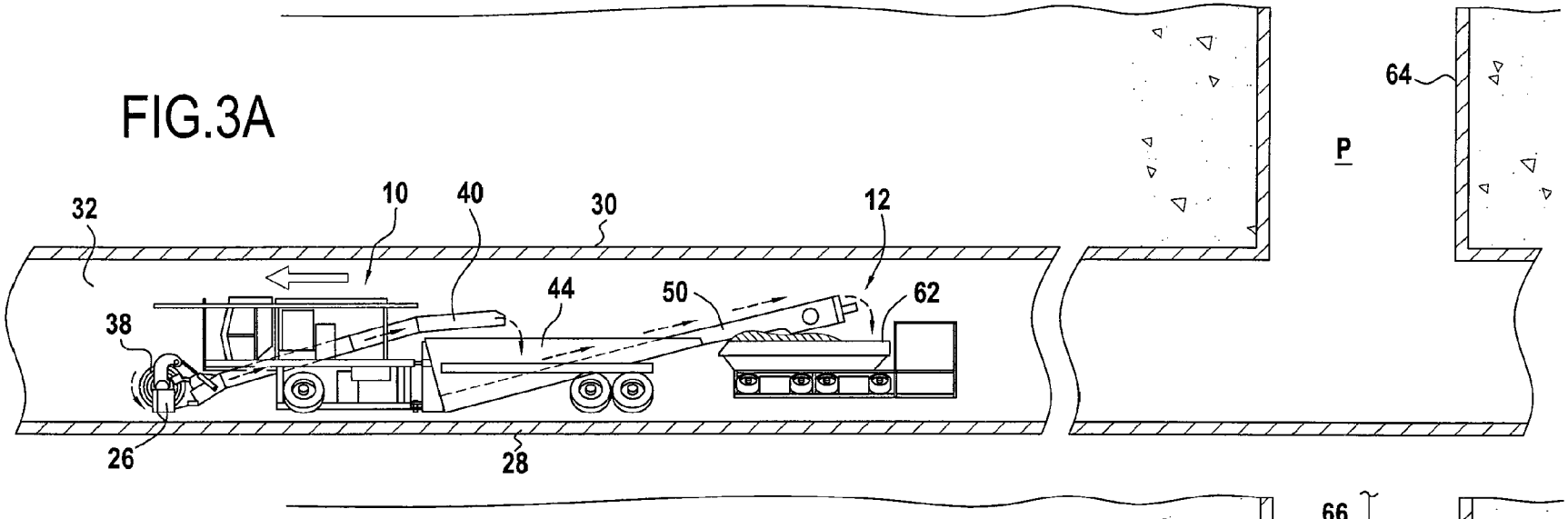
FIGS. 3A and 3B are simplified diagrams showing the implementation of the method of the invention.
Figure 3B:
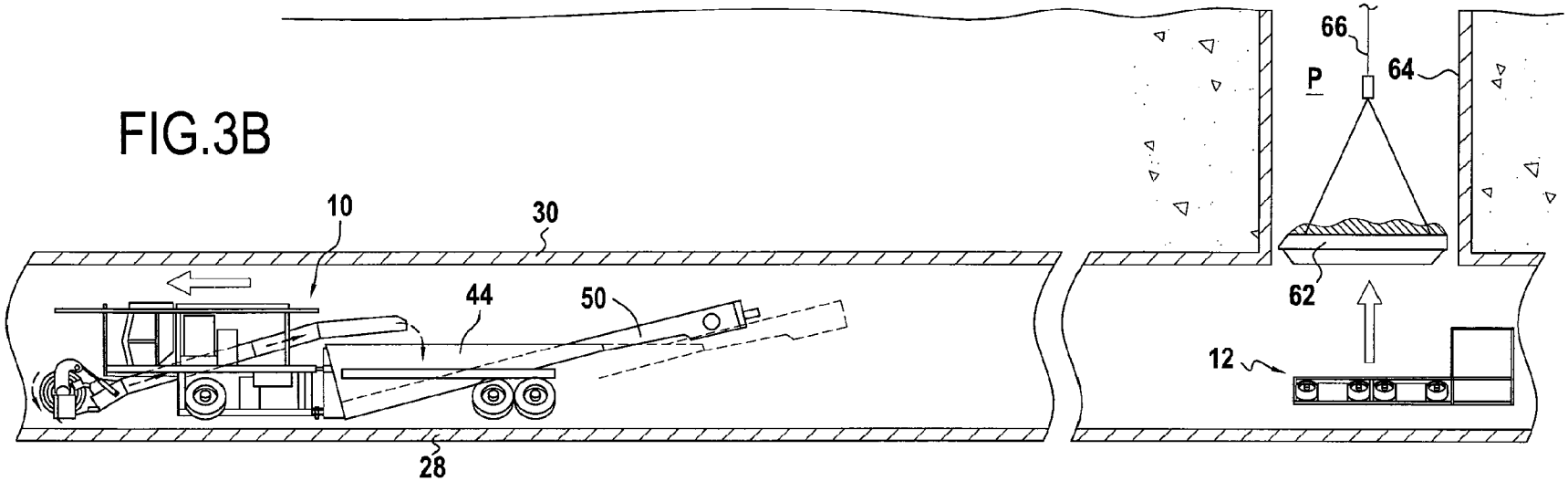

With reference to FIGS. 3A and 3B, there follows a brief description of the way in which the scraper machine of the invention is used.

As sediment is detached by the scraper blade 26, it is transferred to the storage tank 44 via the loader auger 38 and the first conveyor 40. When the tank 44 is sufficiently full of sediment, the removal vehicle 12, located behind the scraper vehicle 10, is filled with the sediment by means of the second conveyor 50. The removable skip 62 of the removal vehicle 12 is thus filled. Once this operation has been performed, the conveyor 50 is stopped and the removal vehicle 12 travels to the unloading point P corresponding to an access 64 into the gallery 32. When the removal vehicle 12 comes into register with the access 64, hoist means 66 serve to extract the removable skip 62 full of sediment or debris and to replace it with an empty skip 62, which is put into place on the removal vehicle 12. This vehicle then returns to the scraper vehicle 10 and it follows the slow advance of the scraper vehicle 10. When the tank 44 is full, it is again unloaded into the skip 62 of the removal vehicle 12 as explained above. During this operation, the conveyor 40 continues to transfer sediment into the tank 44. The total quantity of sediment transferred into the skip 62 can thus be equal to the quantity that was in the tank at the beginning of the transfer operation plus the quantity of sediment that is transferred into the tank during the transfer operation.

It will be understood that while the scraper vehicle 10 is still far away from the maximum distance that it is to act from the loading point, the trips performed by the removal vehicle 12 are relatively short, and apart from the time taken for a go-and-return trip, the removal vehicle follows the scraper vehicle. In contrast, when the scraper vehicle 10 is close to the maximum expected distance for treating the drain, the removal vehicle 12 remains beside the scraper vehicle substantially only for the time required to transfer sediment or debris from the tank 44 to the skip 62 via the conveyor 50.

A preferred embodiment of the invention is described above. Nevertheless, it is clear that numerous variants could be envisaged. In particular, the movable bodies constituted by the scraper vehicle 10 and the removal vehicle 12 need not be self-propelled and they could be driven by external propulsion means. Or else the scraper vehicle 10 and the removal vehicle 12 could be self-propelled but under automatic remote control.

Instead of the second sediment transfer means constituted by the conveyor 50 being mounted on the scraper vehicle 10, as described above, it is also possible to make provision for the second transfer means to be mounted on the removal vehicle. Under such circumstances, the second transfer means may be constituted for example by a suction pipe or by an auger system for transferring sediment from the tank 44 to the skip 62.

In certain stages of operation of the machine, the removal vehicle 12 may also be used for transporting fuel for the scraper vehicle 10, personnel, or indeed other elements for maintaining the scraper vehicle.

What is claimed is:

1. A machine for scraping away, without interruption, material deposited on a bottom of a gallery, wherein the machine comprises:

a first movable body suitable for moving over a bottom portion of a wall of the gallery, said first movable body presenting a front and a rear and including a first movement device for enabling said first movable body to move on the bottom portion of the wall of the gallery;

a scraper for detaching material from the bottom of the gallery and mounted at the front of said first movable body;

a first storage as a buffer storage mounted on said first movable body;

a first transfer device for continuously transferring detached material into said buffer storage; and a second transfer device mounted on said buffer storage for transferring material stored in said buffer storage device to the outside of said first movable body;

wherein the machine further comprises a second movable body distinct from the first movable body, suitable for moving along the bottom portion of the wall of the gallery either in convoy with the first movable body or independently and away from said first movable body, and including a second movement device for enabling said second movable body to move on the bottom portion of the wall of the gallery; and a second storage mounted on said second movable body to collect the material transferred to the outside of the first movable body by the second transfer device, and wherein the buffer storage is suitable, when supplied with material by the first transfer device, for storing said material when the second movable body is away from the first movable body and transferring material into the second storage via the second transfer device when the second movable body moves in convoy with the first movable body.

2. A machine according to claim 1, wherein said first movement device is a first motor device mounted on the first movable body.

3. A machine according to claim 1, wherein said second movement device is the second motor device mounted on the second movable body.

4. A machine according to claim 1, wherein said first transfer device comprises a loader auger, placed in register with the scraper, and a conveyor having a first end, co-operating with the loader auger and the scraper, and a second end that is located above the buffer storage.

5. A machine according to claim 1, wherein said buffer storage is located at the rear of the first movable body.

6. A machine according to claim 1, wherein said second storage is removable relative to said second movable body.

7. A machine according to claim 1, wherein said buffer storage comprises a buffer tank.

* * * * *